US006453911B1

(12) United States Patent
Silva

(10) Patent No.: US 6,453,911 B1
(45) Date of Patent: Sep. 24, 2002

(54) CLIP END HAIR FASTENER

(76) Inventor: David Alan Silva, 632 Loma Prieta, Aptos, CA (US) 95003

( * ) Notice: Subject to any disclaimer, the term of this patent is extended or adjusted under 35 U.S.C. 154(b) by 0 days.

(21) Appl. No.: 09/860,080

(22) Filed: May 16, 2001

(51) Int. Cl.[7] ..... A45D 8/12
(52) U.S. Cl. ..... 132/275
(58) Field of Search ..... 132/275, 277, 132/273, 128, 64.1; D28/39, 40, 41; 24/300, 301; 2/323

(56) References Cited

U.S. PATENT DOCUMENTS 1,532,211 A * 4/1925 Wesleck ..... 2/323
1,782,057 A * 11/1930 Bollinger ..... 24/301
3,055,377 A * 9/1962 Guinett ..... 132/275
5,142,807 A * 9/1992 Sweet ..... 24/300
5,690,128 A * 11/1997 Grimes ..... 132/128
5,758,914 A * 6/1998 Ioveno ..... 24/301
5,884,371 A * 3/1999 Huggins ..... 24/300
6,260,559 B1 * 7/2001 Schirren et al. ..... 132/275

* cited by examiner

*Primary Examiner*—Todd E. Manahan

(57) ABSTRACT

A clip end hair fastening band for fastening and styling hair comprising an elastic band with jaw-toothed clips integrally attached to each end. The user clamps the first clip to the hair with teeth penetrating section. The user then wraps the band around, over or under hair and secures the second clip to the hair, with teeth penetrating the section.

4 Claims, 3 Drawing Sheets

CLIP END HAIR FASTENER

BACKGROUND OF THE INVENTION

1. Field of the Invention

The present invention relates to a hair fastening band and method, more particularly an elastic band with jaw toothed hair clips integrally attached to each end.

2. Description of Prior Art

Many people like to secure their hair up and away from their face in various styles. One way to put the hair up is to use a headband or hair band. Traditionally a headband consists of a length of fabric formed into a loop and is placed around the head. A hair band, also traditionally formed into a loop, is secured around a section of hair. Both are effective, however, they both often become loose and less supportive over time.

Another way to secure hair is to use a bungee type fastener with hooks at each end. These are effective for a hairstylist, however, they are difficult to use and extremely difficult to remove for the user.

SUMMARY OF THE PRESENT INVENTION

An object of the present invention is to provide an instrument, which is convenient, practical, and inexpensive for use in hair fastening.

A further object is to provide such an instrument that has hinged and moveable jaws inseparably attached to each end of an elastic band.

A further object is to provide such an instrument where each jaw penetrates the hair sections and grasps them tightly.

A further object is to provide such an instrument where the elastic band also grasps the hair.

A further object is to provide such an instrument that can be used unassisted by the individual styling their hair, eliminating the expense of a professional stylist.

A further object is to be able pull up sections of hair and connect them to the band ends.

A further object is to clamp an end of the band to a section of hair, pull up hair while wrapping the band around it, and clamp the second clip to a section of hair to secure the upswept style.

A further object is to provide an instrument that will quickly hold the user's hair up in a multitude of neatly secured styles. A further object is to provide a hair fastening band that doesn't become loose on the user's head.

A further object is to provide a hair fastening band that can be used as a headband.

A further object is to provide a hair fastening band that can be used for securing a ponytail.

According to one aspect of the present invention, there is provided a hair fastening band comprising an elastic, resilient band, and a spring-loaded jaw-toothed hair clip inseparably attached to each end of the band.

According to the arrangement described above the band ends are secured to the clips in such a way that the teeth of the hair clips can penetrate the user's hair to grasp it and secure the band to the hair. The clips are the "bulldog" type, wherein the gripping arms of the clips bend in a direction away from the clips pivot in a concave since. Further, because the band is elastic, the band is adjustable to different size heads. However, a buckle for adjusting the band length could be added to the band.

Accordingly a preferred embodiment of the present invention the resilient band is a long length of elastic fabric and the clips are spring loaded. The spring loaded clips have a jaw like shape and the band can be glued to the inside of one half of each clip, put through an opening of each clip top intermediate the spring and one side of the clip handle and knotted, simply tied to each clip, or any other way to secure it will work as long as the band doesn't get in the way of the teeth penetrating the hair.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
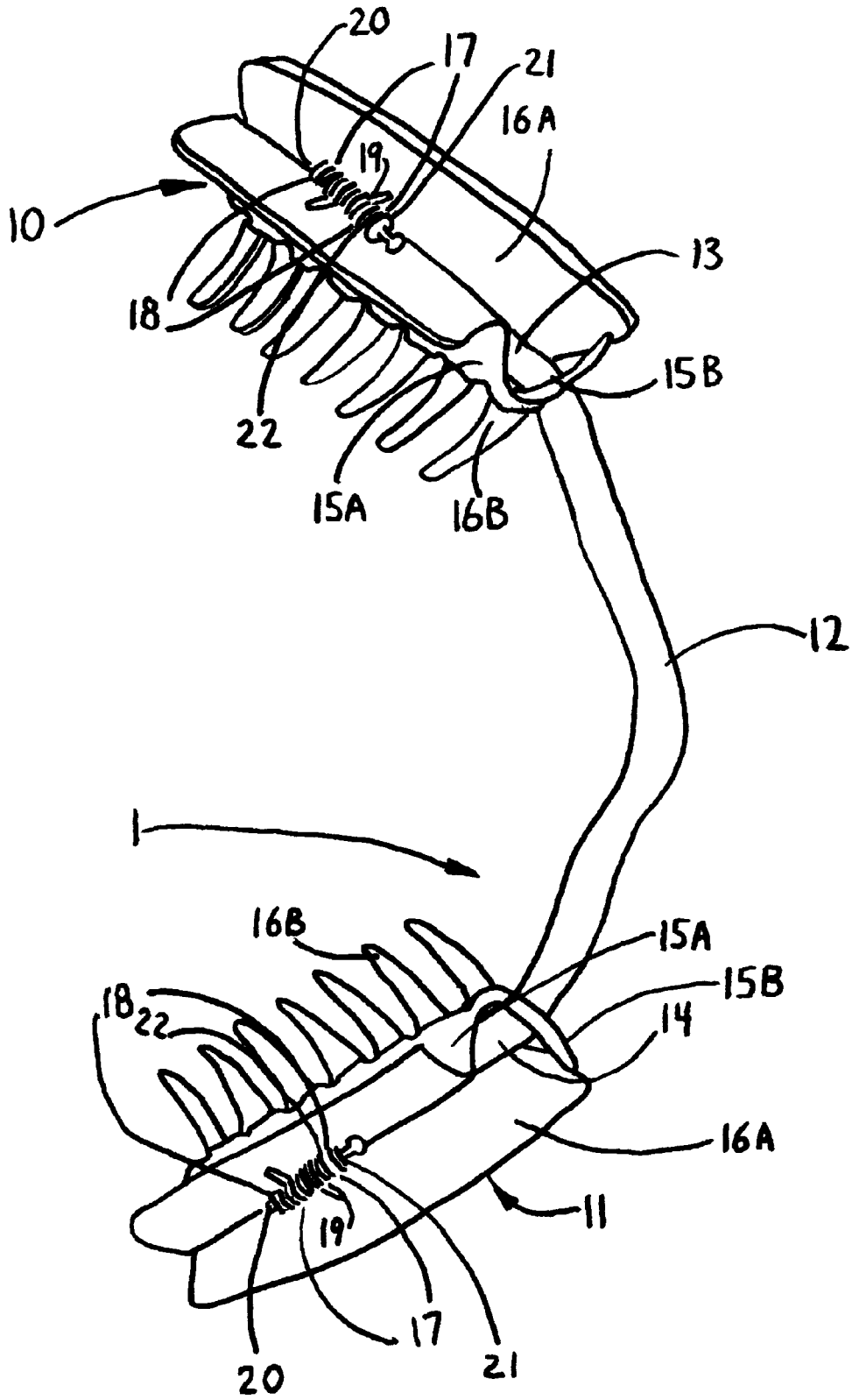
FIG. 1 is a plan view showing an elastic hair band with spring-loaded jaw clips attached to each end according to the present invention.
Figure 2:
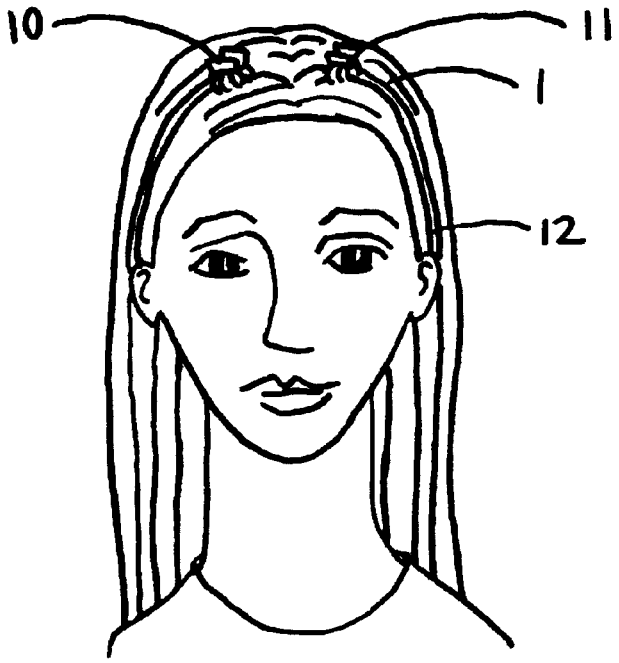
FIG. 2 is a schematic view of the hair fastening band secured to the user's hair.
Figure 3:
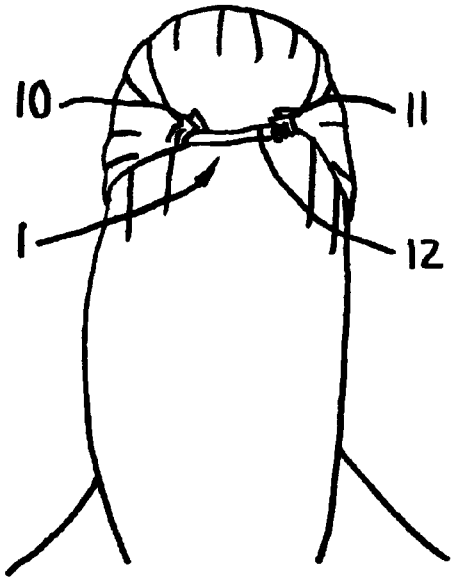
FIG. 3 is a view of another method of use of the current invention.

Referring to FIGS. 1 through 3 of the accompanying drawings. There is illustrated a hair fastening band embodying the present invention. The hair band,; generally designated by reference numeral 1, comprises a first clip end 10 and a second clip end 11. The resilient band generally designated by reference numeral 12, comprises a first end 13 and a second end 14. In this embodiment the clips 10 and 11 have a first jaw and handle portion 15*a* with teeth 15*b* penetrating from jaw and handle portion 15*a* and a second jaw and handle portion 16*a* with teeth 16*b* penetrating from jaw and handle portion 16*a*. Each portion 15*a* and 16*a* has a pair of lugs 17 and 18. The lugs 17 and 18 are aligned with a spring 19 intermediate them and a pin 20 is placed through holes 21 and 22 of lugs 17 and 18. Wherein the first jaw and handle portion 15*a* is secured to the second jaw and handle portion 16*a*. The band ends 13 and 14 are integrally attached to clips 10 and 11. The clip portions 10 and 11 are made of plastic and the band is made of some type of resilient fabric such as elastic.

In use FIG. 2 of the hair band 1 described above, the first clip end 10 is clamped to a section of hair, with teeth 15*b* and 16*b* penetrating the hair. The band 12 is wrapped around the head and the second clip 11 is clamped to a section of hair, with teeth 15*b* and 16*b* penetrating the hair to finish the style.

In another use FIG. 3 the first clip 10 is clamped to a section of hair such as a side section above the left ear with teeth 15*b* and 16*b* penetrating the hair. The user then pulls the band 12 across the head and then clamps the second clip 11 to a second side section above the right ear with teeth 15*b* and 16*b* penetrating into the hair to secure.

Figure 4:
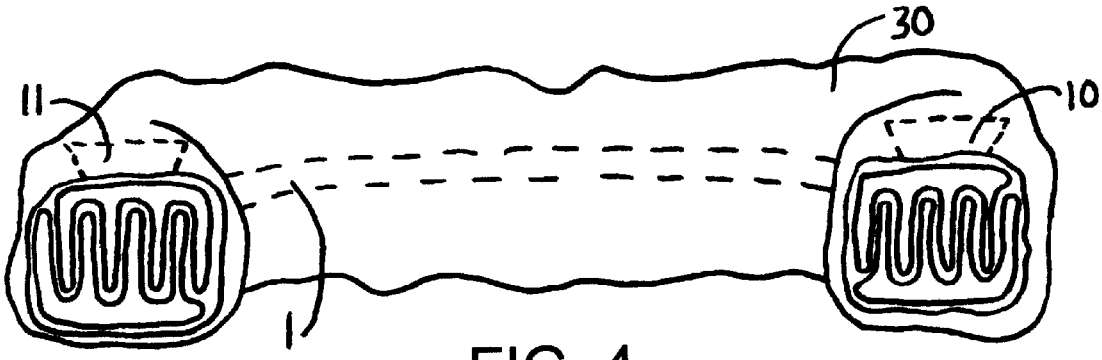
FIG. 4 is a plan view of another embodiment of the current invention.

FIG. 4 shows a fabric covering 30 covering band 1 and clips 10 and 11 leaving an opening for teeth 15*b* and 16*b*.

Figure 5:
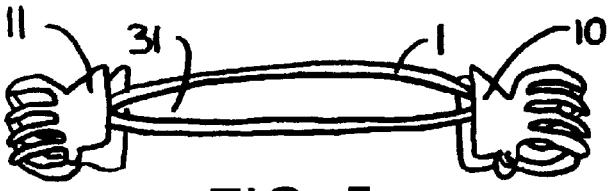
FIG. 5 is a plan view of another embodiment of the current invention.
Figure 6:
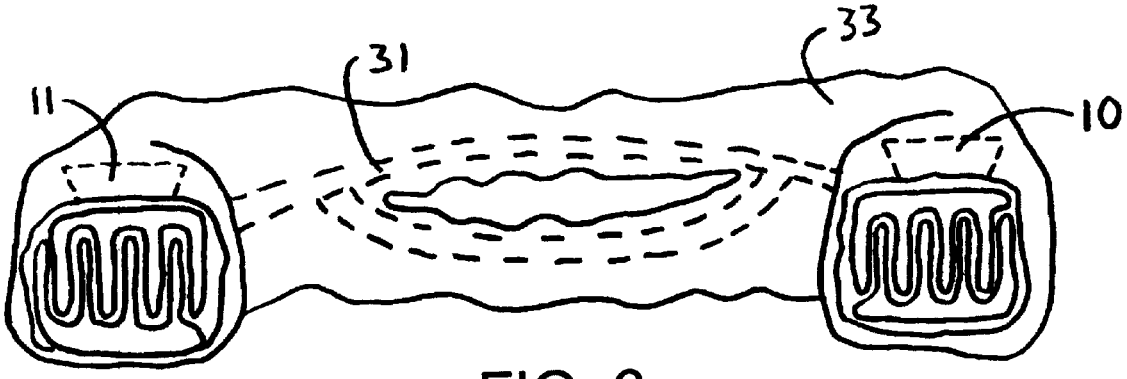
FIG. 6 is a plan view of another embodiment of the current invention.

In FIG. 5 the band 1 has an opening 31. FIG. 6 shows an additional fabric covering 33 covering the band 1 and clips 10 and 11 of FIG. 5 leaving an opening for teeth 15 and 16.

The present invention being thus described, it is obvious that the same embodiment and uses may be varied in many ways. For instance, the clip portions can be of different shapes, sizes or configurations as long as they have teeth that fasten to the hair by penetrating the section in a grasping motion, the jaws have a mutual pivotal connection, and the clips have a way to open and close the jaws. The band portion can be of different shapes, sizes, or materials, such as cotton or a swatch of hair. There could be additional claws secured along the band for securing additional sections of hair to the band underside. The band could be woven through a buckle (like a bra band) so it could be adjusted to different sizes. The clips don't have to be secured directly at the band ends, they could be close to the ends. Any way to style the hair with the present embodiment applies. Further, any way to inseparably attach the band ends to the clips will work. Such variations are not to be regarded as a departure from the spirit and scope of the invention, and all such variations as would be obvious to those skilled in the art are intended to be included within the scope of the following claims,

What is claimed is:

1. A method of securing and styling hair comprising: selecting a hair fastening band comprising:

a band with spring loaded jaw-toothed clips integrally attached to each end of said band;

clamping said first jaw-toothed clip to a section of hair with teeth penetrating said section of hair;

placing said band across, around, or under a section of hair; and securing said second jaw clip to a section of hair to the secure finished style.

2. A hair fastening band for use in styling hair of a human being comprising in combination:

a length of resilient fabric; a clip integrally attached to each end of said resilient fabric; both said clips comprising a pair of jaws having a mutual pivotal connection, each of said jaws having an edge portion spaced from said pivotal connection, said edge portion being formed with mutually engaging gripping teeth; said edge portion and said gripping teeth being bent in a concave sense in a direction away from said pivotal connection; said clip further comprises spring means which urges said edge portions of said jaws together and said gripping teeth into mutual engagement;

said clips further comprising a pair of ears disposed on the side of said spring means remote from said jaw;

whereby, said ears are pressed together and said jaws are opened against a force exerted by said spring means such that a section of hair of said human being may be fastened by said first clip with said teeth grasping said hair when said ears are released; said band may be secured around, over, or under said hair such that said resilient fabric holds said hair in place; and said second clip may be fastened to a section of hair with said teeth grasping said hair to secure the finished style.

3. A hair fastening band for use in styling hair of a human being comprising in combination:

a length of resilient fabric; a clip integrally attached to each end of said resilient fabric; both said clips comprising a pair of jaws having a mutual pivotal connection, each of said jaws having an edge portion spaced from said pivotal connection, said edge portion being formed with mutually engaging gripping teeth; said clip further comprises spring means which urges said edge portions of said jaws together and said gripping means into mutual engagement;

said clips further comprising a pair of ears disposed on the side of said spring means remote from said jaw;

an additional layer of fabric is attached by attaching means to cover said length of resilient fabric and to partially cover said clips; wherein an opening is left around said teeth allowing said teeth to penetrate said hair sections while the rest of the band and clips remain hidden within said fabric, whereby, said ears are pressed together and said jaws are opened against a force exerted by said spring means such that a section of hair of said human being may be fastened by said first clip with said teeth grasping said hair when said ears are released; said band may be secured around, over, or under said hair such that said resilient fabric holds said hair in place; and said second clip may be fastened to a section of hair with said teeth grasping said hair to secure the finished style.

4. A hair fastening band for use in styling hair of a human being comprising in combination:

a length of non-resilient material; a clip integrally attached to each end of said non-resilient material;

both said clips comprising a pair of jaws having a mutual pivotal connection, each of said jaws having an edge portion spaced from said pivotal connection, said edge portion being formed with mutually engaging gripping teeth; said edge portion and said gripping teeth being bent in a concave sense in a direction away from said pivotal connection; said clip further comprises spring means which urges said edge portions of said jaws together and said gripping means into mutual engagement;

said clips further comprising a pair of ears disposed on the side of said spring means remote from said jaw;

whereby, said ears are pressed together and said jaws are opened against a force exerted by said spring means such that a section of hair of said human being may be fastened by said first clip with said teeth grasping said hair when said ears are released; said band may be secured around, over, or under said hair such that said non-resilient material holds said hair in place; and said second clip may be fastened to a section of hair with said teeth grasping said hair to secure the finished style.

* * * * *